US005205265A

United States Patent [19]

Kashiyama et al.

[11] Patent Number: 5,205,265

[45] Date of Patent: Apr. 27, 1993

[54] EXHAUST GAS RECIRCULATION SYSTEM

[75] Inventors: Kenji Kashiyama, Hiroshima; Kazumasa Nomura, Higashihiroshima; Noriyuki Iwata; Naoyuki Yamagata, both of Hiroshima, all of Japan

[73] Assignee: Mazda Motor Corporation, Hiroshima, Japan

[21] Appl. No.: 858,999

[22] Filed: Mar. 30, 1992

[30] Foreign Application Priority Data

Mar. 28, 1991 [JP] Japan ..... 3-089769

[51] Int. Cl.[5] ..... F02M 25/06; F02M 25/07

[52] U.S. Cl. ..... 123/570; 123/572; 60/605.2

[58] Field of Search ..... 123/568, 569, 570, 572, 123/573, 574; 60/605.2, 274, 278

[56] References Cited

U.S. PATENT DOCUMENTS 3,224,188 12/1965 Barlow ..... 123/570 X
4,323,045 4/1982 Yamashita ..... 123/570
4,356,806 11/1982 Freesh ..... 123/570
4,467,774 8/1984 Becker et al. ..... 123/570 X
4,771,602 9/1988 Ruiz et al. ..... 123/568 X
4,779,600 10/1988 Asaga et al. ..... 123/568

FOREIGN PATENT DOCUMENTS 56-109646 3/1981 Japan .
176312 10/1982 Japan ..... 123/570
59-155520 9/1984 Japan .

*Primary Examiner*—Willis R. Wolfe
*Attorney, Agent, or Firm*—Keck, Mahin & Cate

[57] ABSTRACT

An exhaust gas recirculation system of an engine equipped with a supercharger has an exhaust gas circulation passage for circulating exhaust gas into an intake system from an exhaust system, and a return passage for returning exhaust gas introduced into the exhaust gas circulation passage to the exhaust system. The exhaust gas circulation passage is made available to the exhaust gas when the engine operates within a specified area of engine operating conditions in which supercharging is to be effected. The return passage is made available to the exhaust gas when the engine operates within an area, other than the specified area, of engine operating conditions.

12 Claims, 3 Drawing Sheets

EXHAUST GAS RECIRCULATION SYSTEM

BACKGROUND OF THE INVENTION

1. Field of the Invention

This invention relates to an improved exhaust gas recirculation system for circulating a portion of exhaust gases back into an air intake system. Combustion temperature in the recirculation system is kept low in order to decrease the emission of nitrogen oxide and eliminate knocking due to excessively premature combustion.

Conventionally, automobile engines are endowed with an exhaust gas recirculation (EGR) system which recirculates inert exhaust gases into an intake system in order to keep combustion temperatures relatively low. This helps prevent nitrogen oxide emissions from being produced and discharged. Such an automobile engine is also endowed with a positive crankcase ventilation (PCV) system for recirculating what is known as "blowby" gas. Compressed and/or combustion gas, blown through cylinders into an engine crankcase, is introduced into the intake system so as to prevent it from escaping into the atmosphere.

2. Description of Related Art

In recent years, such engines have also been equipped with superchargers. A turbine of such a supercharger is either driven by the energy of exhaust gasses from the engine or mechanically driven by the engine so as to supply compressed air into the intake system for the purpose of increasing an air charging rate and thereby improving the output performance of the engine. Of course, the use of a supercharger increases the air pressure in an air intake pipe of the intake system while supercharging occurs. Various types of exhaust gas recirculation (EGR) systems and positive crankcase ventilation (PCV) systems, have been proposed to efficiently introduce exhaust gases and blowby gases into an intake pipe with high pressure air. Examples of such systems and positive crankcase ventilation (PCV) systems are known from, for instance, Japanese Patent Application No. 58-29,699, entitled "Blowby Gas Recirculation System For Engine With A Supercharging Feature," filed on Feb. 23, 1983 and now opened to public as Japanese Unexamined Patent Publication No. 59-155,520, and Japanese Utility Model Application No. 55-7,350, entitled "Exhaust Gas Recirculation System For Engine," filed on Jan. 23, 1978 and now opened to public as Japanese Unexamined Utility Model Publication No. 56-109,646.

In the exhaust gas recirculation systems described in these publications, however, exhaust gases, when circulated into the air intake systems, leave carbon deposits on the inside walls of intake pipes of the air intake systems. When carbon masses are separated from the pipe walls or shaken loose, possible damage to the engines can occur. If an exhaust gas recirculation system is used with an engine having a supercharger and directs exhaust gases into an intake pipe upstream of the supercharger, the system can still introduce exhaust gas with high efficiency even at high supercharging rates. Nonetheless, such an exhaust gas recirculation system produces carbon deposits which seep into very narrow openings inside the supercharger, thereby decreasing the operational reliability of the supercharger. The decrease in operational reliability is particularly critical with a positive-displacement type of supercharger.

SUMMARY OF THE INVENTION

It is an object of the present invention to provide an exhaust gas circulation system of an internal combustion engine for an automotive vehicle which prevents carbon particles contained in exhaust gases from being circulated and introduced into an air intake system. The exhaust gas circulation system of this invention, therefore, protects the engine against trouble caused by inhalation or intake of carbon particles.

This object is achieved by providing an exhaust gas recirculation system, or EGR system, interconnected between an intake system and an exhaust system, which has an exhaust gas circulation pipe connected to the intake system downstream of a location at which a throttle valve is disposed. In the exhaust gas circulation pipe, an exhaust gas cooling means and an exhaust gas filtering means are provided, in that order, from the exhaust system. The exhaust gas recirculation system has a blowby gas circulation system with a blowby gas circulation pipe, which is interconnected to the engine and the exhaust gas circulation pipe between the exhaust gas cooling means and the exhaust gas filtering means. Exhaust gas introduced into the exhaust gas recirculation system is cooled by the exhaust gas cooling means before returning into the intake system. After the gas pressure and the flowing speed of the exhaust gas is reduced, due to resistance provided by the cooling means to exhaust gas flow, the exhaust gas is mixed with blowby gas introduced through the blowby gas circulation system. Consequently, carbon particles contained in the exhaust gas are mixed with oil mist conveyed by the blowby gas before the exhaust gas passes through the exhaust gas filtering means. This enables both carbon particles in the exhaust gas and oil mist in the blowby gas to be effectively filtered.

The exhaust gas circulation system is provided with an exhaust gas bypass passage branching off from and connected again to the exhaust gas circulation pipe so as to bypass the exhaust gas cooling means. The exhaust gas bypass passage is opened by a bypass valve means so as to be available to the exhaust gas according to engine operating conditions. Upon returning into the intake system without passing, i.e., by bypassing, the exhaust gas cooling means, the exhaust gas, which is at a high temperature, dries the inside of the exhaust gas filtering means and carbonizes a mixture of carbon particles contained therein and oil mist conveyed by the blowby gas.

When the exhaust gas recirculation system is used with an internal combustion engine equipped with a supercharger installed in the intake system, the exhaust gas circulation pipe is connected to the intake system before, or upstream of, the supercharger. When the engine operates in a specific area of operating conditions in which supercharging is effected, the exhaust gas bypass is closed, i.e., the exhaust gas circulation passage is opened, so that the exhaust gas recirculation system circulates exhaust gas passed through the cooling means into intake air, thereby supercharging sufficiently cooled exhaust gas into fresh intake air. As a result, premature combustion and knocking are desirably prevented. Decreasing the combustion temperature suppresses the generation of nitrogen oxidation. On the other hand, when the engine operates in an area of operating conditions other than the specific area of operating conditions, in which no supercharging is effected, the exhaust gas bypass is opened so as to force the exhaust gases to bypass the cooling means before reaching the filtering means. Consequently, exhaust gas at a high temperature drys the filter means as it flows through the filter means and carbonizes carbon particles and oil mist.

A blowby gas bypass passage is connected with the intake system between the supercharger and a location at which the exhaust gas passage is connected to the system so as to let blowby gas bypass the filtering means of the exhaust gas recirculation system. The blowby gas bypass passage is made available when the engine operates within the area of operating conditions so that it does not need recirculation of exhaust gases, forcing the blowby gas to flow into intake air, bypassing the exhaust gas filtering means of the exhaust gas recirculation system. With this exhaust gas recirculation system, regardless of whether the exhaust gas circulation pipe is open or closed, blowby gas can ordinarily be introduced into fresh intake air.

BRIEF DESCRIPTION OF THE DRAWINGS

The above and other objects and features of the present invention will be apparent from the following description of a preferred embodiment of the present invention when considered in conjunction with the appended drawings, in which.

DETAILED DESCRIPTION OF THE PREFERRED EMBODIMENT

Figure 1:
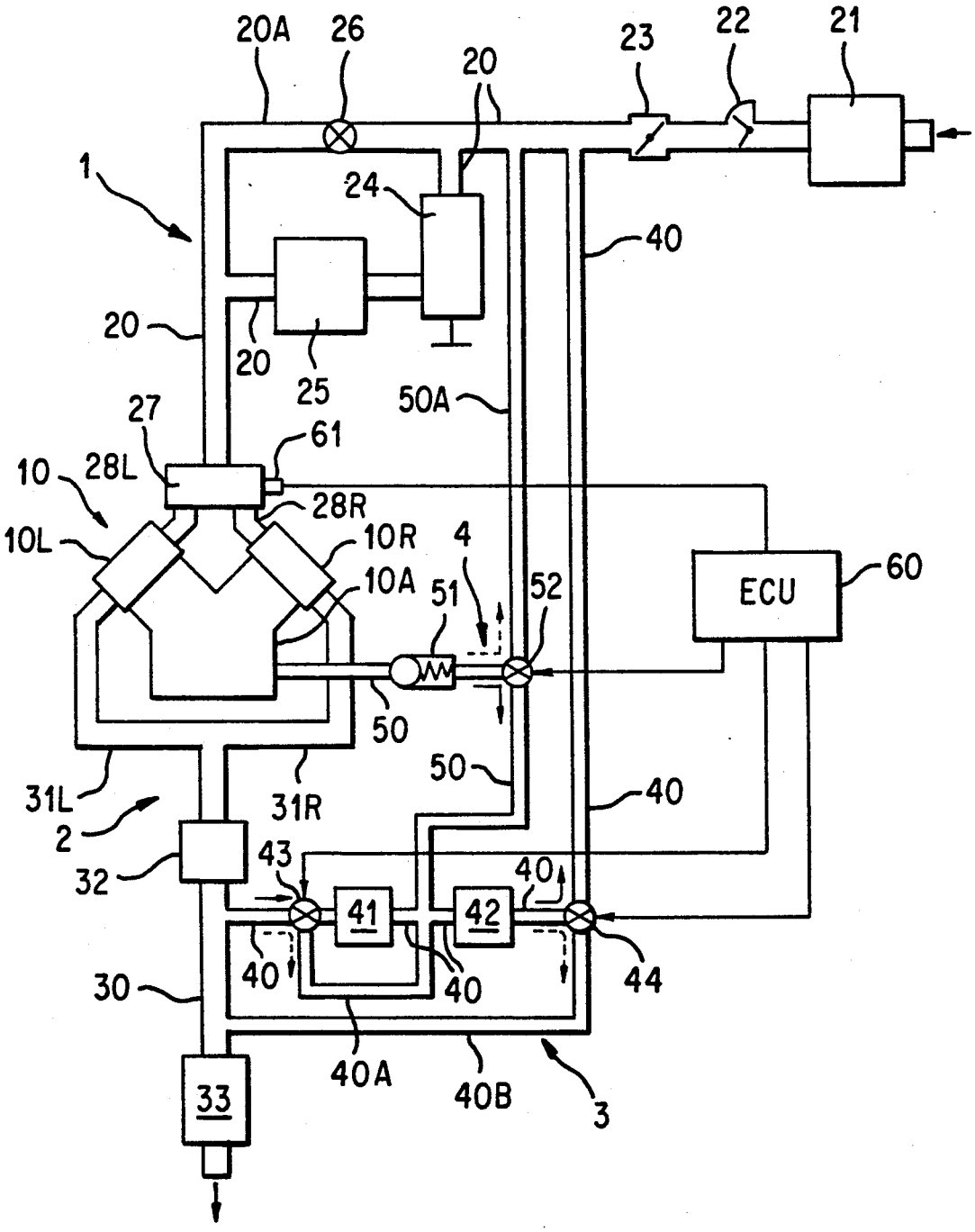
FIG. 1 is a schematic illustration showing an exhaust gas circulation system in accordance with a preferred embodiment of the present invention.

Referring to the drawings in detail and, in particular, to FIG. 1, an exhaust gas recirculation (EGR) system in accordance with a preferred embodiment of the present invention is shown as being used with a V-type internal combustion engine 10 including right and left cylinder banks 10R and 10L, arranged in a V-formation and at a predetermined relative angle, and a crankcase 10A. The engine 10 has an air intake system 1 which includes right and left intake manifolds 28R and 28L, a surge tank 27 and an intake pipe 20. Each intake manifold 28R or 28L extends and is connected between the respective cylinder bank 10R or 10L and the surge tank 27. From its upstream end, the intake pipe 20, extending from the surge tank 27, is provided, in order, with an air filter 21, an airflow meter 22, a throttle valve 23, a supercharger 24 and an intercooler 25.

Supercharger 24 is what is called a "Lisholm" type compressor which, although not shown in detail, is known in structure and operation. Such a supercharger comprises a pair of rotors rotatably installed with their axes of rotation parallel to each other in a supercharger casing. One of the rotors is formed with spiral ridges, and the other rotor is formed with grooves complementarily meeting with the ridges of the one rotor. As the rotors turn in opposite directions, spaces formed between the inner wall of the supercharger casing and the ridges of the rotor decrease in volume. Consequently, air in the spaces is compressed and propelled in a direction of the axis of rotation of the rotor shaft.

Figure 3:
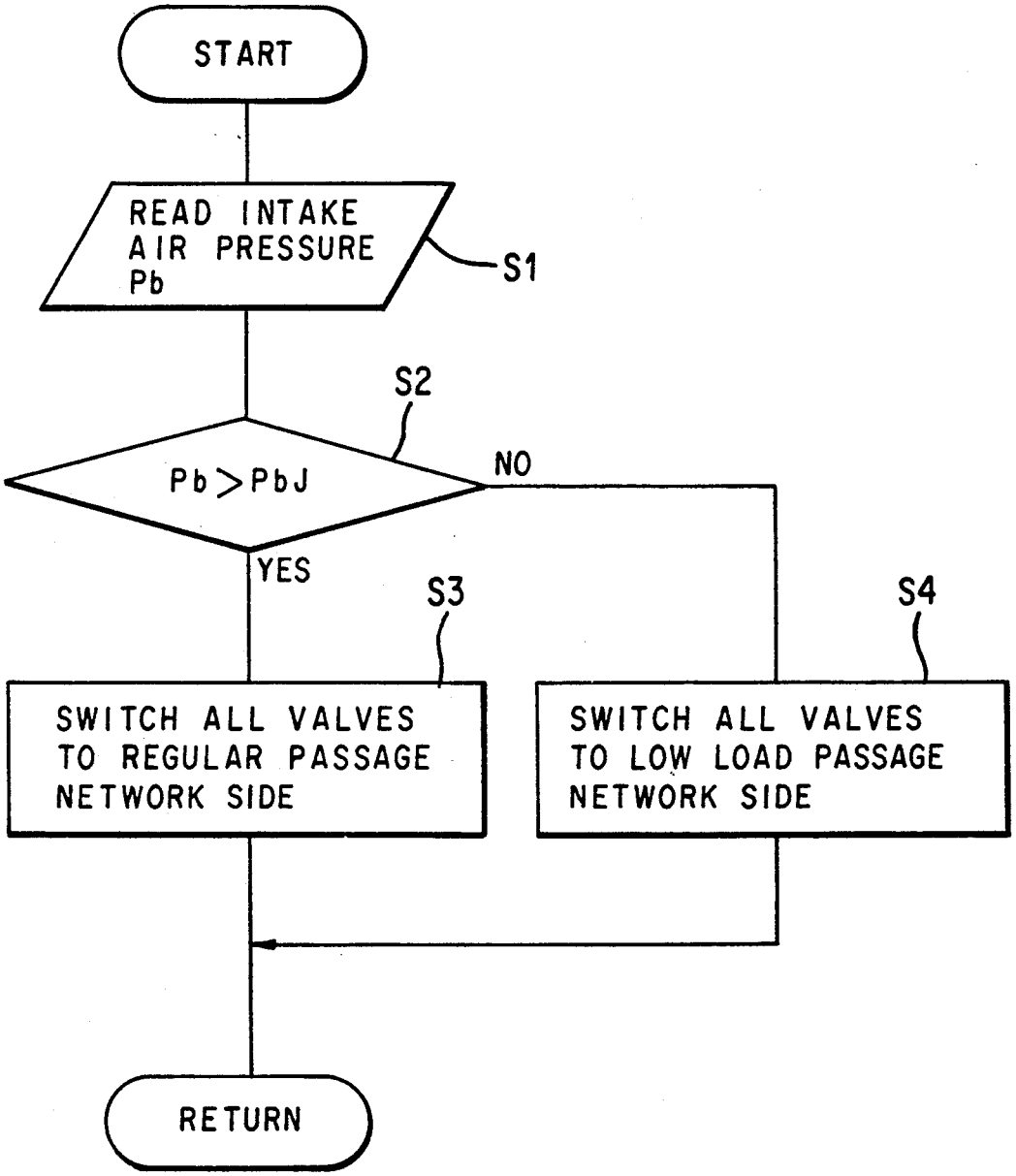
FIG. 3 is a diagram showing supercharging characteristics on the basis of engine speed and engine load torque.

Intake pipe 20 is endowed with a bypass pipe 20A which bypasses the supercharger 24 and the intercooler 25. The bypass pipe 20A is equipped with a valve 26 which opens and closes the bypass pipe 20A so as to regulate air flow within the bypass pipe 20A, thereby controlling air pressure created by the supercharger 24 which continuously operates. In other words, opening the valve 26 in the bypass pipe 20A prevents the air compressed by the supercharger 24 from flowing into the surge tank 27, and no supercharging is effected. Closing the valve 26 allows the air compressed by the supercharger 24 to reach the surge tank 27, and supercharging is effected. The valve 26 varies its opening according to throttle openings in such a way that the valve 26 is initially continuously kept fully opened until the throttle opens to a predetermined opening, is gradually closed proportionally to openings of the throttle, and is finally fully closed when the throttle fully opens. As is shown in FIG. 3, illustrating the correlation between engine speed (N) and torque load (T), supercharging is effected for torque loads higher than a torque load curve (NC-WOT). This torque load curve (NC-WOT) represents the widest or full opening of the throttle valve 26 for all engine speeds at which no supercharging is effected.

Surge tank 27 is provided with an engine operating condition sensor, such as a pressure sensor 61, to detect the pressure of supercharged intake air supplied by the supercharger 24 and sends an electric signal as pressure information to an electronic control unit 60. The control unit mainly comprises a micro-computer and will be described in detail in later.

Engine 10 further has an exhaust system 2, which includes right and left exhaust manifolds 31R and 31L. Each exhaust manifold 31R or 31L extends from the respective cylinder bank 10R or 10L and is connected to a common exhaust pipe 30. Exhaust gases are discharged from the exhaust pipe 30 and pass through a catalytic converter 32 and a muffler 33 disposed in the exhaust pipe 30.

Between the intake system 1 and the exhaust system 2, there is disposed an exhaust gas recirculation (EGR) system 3. The exhaust gas recirculation (EGR) system 3 has an exhaust gas recirculation pipe 40, specifically interposed between an upstream part of the intake pipe 20, upstream of the supercharger 24, and a downstream part of the exhaust pipe 30, downstream of the catalytic converter 32. The recirculation pipe 40 is provided, in order from the exhaust system 2, with an exhaust gas cooling means or EGR cooler 41 and an exhaust gas filtering means or EGR filter 42. The EGR cooler 41, not shown in detail in the drawing figures, may be a water-cooled heat exchange device. The EGR cooler 41 is designed to rapidly and constantly cool exhaust gases passing through the recirculation pipe 40. The EGR filter 42 is made of foamed aluminum designed to allow gases to pass through its porous structure but to filter off any solid particles. The recirculation pipe 40 has a bypass pipe 40A which bypasses the EGR cooler 41. Where the bypass pipe 40A branches off from the recirculation pipe 40 upstream of the EGR cooler 41, namely, on a side of the exhaust pipe 30 with respect to the EGR cooler 41, there is disposed a first, or upstream, passage exchange valve 43. The passage exchange valve 43 is controlled by the electronic control unit (ECU) 60 to selectively render the recirculation pipe 40 and the bypass pipe 40A available. The recirculation pipe 40 further has a return pipe 40B branching off therefrom upstream with respect to the EGR filter 42. The return pipe is connected to the exhaust pipe 30 downstream of the location at which the recirculation pipe 40 branches off and upstream of the muffler 33. At the location at which the return pipe 40B branches off, the recirculation pipe 40 is provided with a second, or downstream, passage exchange valve 44, which is controlled by the electronic control unit (ECU) 60 to selectively render the recirculation pipe 40 and the return pipe 40B available.

Exhaust gas recirculation (EGR) system 3 is adapted to cooperate with a positive crankcase ventilation (PCV) system, namely, a blowby gas circulation system 4 interposed between the intake pipe 20 and the recirculation pipe 40. The blowby gas circulation system 4 has a blowby gas circulation pipe 50 which is connected between the crankcase 10A of the engine 10 and the recirculation pipe 40 between the EGR cooler 41 and the EGR filter 42 of the exhaust gas recirculation system 3. The circulation pipe 50 is provided with a stop valve 51 therein. A blowby gas bypass pipe 50A branches off from the circulation pipe 50 downstream of the stop valve 51 and is connected with the intake pipe 20 upstream of the supercharger 24 but downstream of the location at which the exhaust gas circulation pipe 40 is connected. The circulation pipe 50 is provided with a blowby gas passage exchange valve 52 at the location at which the blowby gas bypass pipe 50A branches off. The passage exchange valve 52 is controlled by the electronic control unit (ECU) 60 to selectively render the circulation pipe 50 and the blowby gas bypass pipe 50A available.

The pressure sensor 61 attached to the surge tank (27) sends a control signal representative of supercharged intake air pressure information as engine operating condition to the electronic control unit 60. The electronic control unit regulates all of the passage exchange valves 43, 44 and 52 on the basis of supercharged intake air pressure so as to selectively render the exhaust gas pipes 40, 40A and 40B of the exhaust gas recirculation (EGR) system 3 available to the exhaust gases introduced into the exhaust gas recirculation (EGR) system 3 from the exhaust pipe 30 of the exhaust system 2 as well as to selectively render the blowby gas pipes 50 and 50A of the blowby gas circulation system 4 available to the blowby gases introduced into the blowby gas circulation system 4 from the crankcase 10A of the engine 10. The passage exchange valves 43, 44 and 52 are regulated in two combinations so as to provide two different passage networks, one (a regular passage network) shown by a solid arrow and the other (a low load passage network) by a broken arrow in FIG. 1. When the passage exchange valves 43, 44 and 52 are regulated simultaneously to render the recirculation pipe 40 available, the regular passage network is provided. On the other hand, when the passage exchange valves 43 and 44 are regulated to render the bypass pipe 40A and the return pipe 40B available, respectively, and simultaneously, the passage exchange valve 52 is regulated to render the bypass pipe 50A available, the low load passage network is provided.

In the regular passage network, exhaust gas produced in the engine is returned from the exhaust pipe 30 through the exhaust gas circulation pipe 40, passing through the EGR cooler 41 and the EGR filter 42, into the intake pipe 20 after the stop valve 23 but before the supercharger 24. While the exhaust gas is returned into the intake pipe 20, blowby gas generated in the crankcase 10A is directed to the exhaust gas circulation pipe 40 at a point between the EGR cooler 41 and the EGR filter 42 through the blowby gas circulation pipe 50. The exhaust gas delivered through the exhaust gas circulation pipe 40 is cooled by the EGR cooler 41 and is filtered by the EGR filter 42 before being returned into the intake pipe 20. During this process, the volume of the exhaust gas is decreased so that an increased air charging rate of fresh air introduced into the intake system 1 is developed. This prevents the temperature of intake air from rising, which can possibly cause premature combustion. As a result of the exhaust gas passing through the EGR cooler 41 and a flow resistance of the cooled exhaust gas in the circulation pipe 40, the internal pressure, or the pressure of exhaust gas in the circulation pipe 40, downstream of the EGR filter 41, is reduced. The blowby gas flowing through the blowby gas circulation pipe 50 is easily directed into the exhaust gas circulation pipe 40, resulting in a highly efficient introduction of blowby gases into the exhaust gas recirculation system 3. Oil mist contained in the blowby gas is adsorbed by carbon particles contained in the exhaust gas and develops as relatively large adhesive particles. Such adhesive particles are filtered by the EGR filter 42, so that carbon particles in the exhaust gas are prevented from depositing inside the supercharger 24 and the intake pipe 20. The stop valve 51 in the blowby gas circulation pipe 50 prevents the exhaust gas from flowing back into the crankcase 10A when the exhaust gas is higher in pressure than the blowby gas.

In the low load passage network, the exhaust gas, introduced into the exhaust gas circulation pipe 40 through the exhaust pipe 30, flows through the bypass pipe 40A, bypassing the EGR cooler 41. After passing through the EGR filter 42, the exhaust gas returns back to the exhaust pipe 30, passing through the return pipe 40B. On the other hand, the blowby gas introduced into the blowby bypass circulation pipe 50 flows directly into the intake pipe 20 upstream of the supercharger 24. As a result, the exhaust gas, which does not pass through the EGR cooler 41 and is, therefore, left heated, reaches the EGR filter 42 and dries up the moisture in the EGR filter 42, thereby carbonizing oil mist adsorbed by the carbon particles. This eliminates clogging of the foamed metal of the EGR filter 42. Carbonized particles are discharged into the exhaust pipe 30 together with the exhaust gas.

The operation of the exhaust gas recirculation system depicted in FIG. 1 is best understood by reviewing FIG. 3, which is a flow chart illustrating a valve control sequence for a micro-computer of the electronic control unit 60. Programming a computer is a skill well understood in the art. The following description is written to enable a programmer having ordinary skill in the art to prepare an appropriate program for the micro-computer of the electronic control unit 60. The particular details of any such program would, of course, depend upon the architecture of the particular computer selected.

After reading the pressure of intake air (Pb) based on a signal from the pressure sensor 61 at step S1, a decision is made at step S2 as to whether or not the intake air pressure (Pb) is greater or higher than a predetermined standard intake air pressure (PbJ). When the intake air pressure (Pb) is greater than the standard intake air pressure (PbJ), the passage exchange valves 43, 44 and 52 are switched so as to create the regular passage network at step S3. On the other hand, when the intake air pressure (Pb) is equal to or less than the standard intake air pressure (Pbj), the passage exchange valves 43, 44 and 52 are switched so as to form the low load passage network at step S4.

Figure 2:
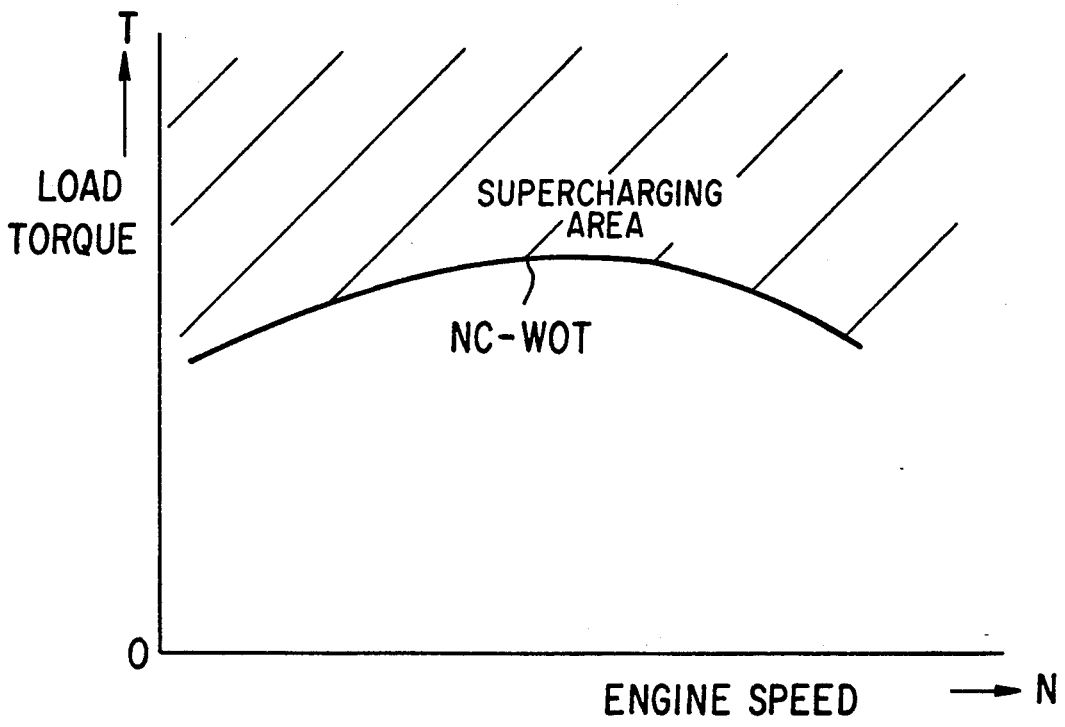
FIG. 2 is a flow chart illustrating gas passage control in the exhaust gas circulation system.

The standard intake air pressure (Pbj) is previously set to a pressure, slightly lower than the atmospheric pressure, at which the supercharger 24 commences supercharging so that the regular passage network is created for higher loads over the supercharging area of engine operating conditions shown in FIG. 2.

As described above, the exhaust gas recirculating system creates the regular passage network at higher loads in the supercharging area in which supercharging is effected. Thus, exhaust gas, introduced into the exhaust gas circulation pipe 40 through the exhaust pipe 30, is forced into the intake pipe 20 passing through the EGR cooler 41 and the EGR filter 42. On the other hand, blowby gas, discharged from the crankcase 10A, is forced into the exhaust gas circulation pipe 40 upstream of the EGR filter 42 and, thereafter, into the intake pipe 20, together with the exhaust gas. In this way, the blowby gas is mixed or combined with the carbonless exhaust gas, passed through the EGR cooler 41 and the EGR filter 42, and recirculated into the intake pipe 20 of the intake system 1. This circulation of exhaust gas and blowby gas prevents premature combustion and the production of nitrogen oxidation owing to lower combustion temperature. Additionally, engine output is increased, owing to increased supercharging pressure.

On the other hand, the exhaust gas recirculating system creates the low load passage network at lighter or lower loads in an area, other than the supercharging area, in which no supercharging is effected. Consequently, exhaust gas, introduced into the exhaust gas circulation pipe 40 through the exhaust pipe 30, flows in the bypass pipe 40A. The exhaust gas bypasses the EGR cooler 41 and then flows into the return pipe 40B after passing through the EGR filter 42, returning to the exhaust pipe 30 downstream of the location at which the exhaust gas circulation pipe 40 branches off. In the low load passage network, high temperature exhaust gas, not passing through the EGR cooler 41, dries and evaporates the moisture in the EGR filter 42, carbonizing the mixture of oil mist and carbon particles. The carbonized particles are discharged into the exhaust pipe 30 passing through the return pipe 40B as well as into the exhaust gas. Discharging carbonized particles helps to clean the EGR filter 42. The low load passage network, though supplying blowby gas directly to the intake pipe 20 upstream of the supercharger 24, keeps oil mist contained in the blowby gas off and prevents it from damaging both the supercharger 24 and the intake pipe 20 of the intake system 1.

It is to be understood that although the present invention has been described in detail with respect to a preferred embodiment thereof, various other embodiments and variants may occur to those skilled in the art. Any such other embodiments and variants which fall within the scope and spirit of the invention are intended to be covered by the following claims.

What is claimed is:

1. An exhaust gas recirculation system of an internal combustion engine, having an intake system for introducing fresh air into the internal combustion engine and an exhaust system for discharging exhaust gas produced in the internal combustion engine therethrough, said exhaust gas recirculation system comprising:

an exhaust gas circulation passage, interposed between said intake system and said exhaust system, for circulating exhaust gas into said intake system from said exhaust system;

filtering means, disposed in said exhaust gas circulation passage, for filtering exhaust gas passing therethrough;

cooling means, disposed in said exhaust gas circulation passage between said filtering means and said exhaust system, for cooling exhaust gas passing therethrough; and a blowby gas passage, connected between the internal combustion engine and said exhaust gas circulation passage at a position between said filtering means and said cooling means, for introducing blowby gas produced in the internal combustion engine into said exhaust gas circulation passage therethrough.

2. An exhaust gas recirculation system as recited in claim 1, and further comprising:

an exhaust gas bypass passage branching off from said exhaust gas circulation passage before said cooling means and again connected to said exhaust gas circulation passage between said cooling means and said filtering means so as to allow exhaust gas introduced into said exhaust gas circulation passage to bypass said cooling means;

bypass valve means, disposed in said exhaust gas circulation passage, for selectively rendering said cooling means and said exhaust gas bypass passage available to said exhaust gas;

detecting means, provided in cooperation with the internal combustion engine, for detecting engine operating conditions; and control means for controlling said bypass valve means to render said exhaust gas bypass passage available to said exhaust gas when said detecting means detects an engine operating condition falling within a specified area of engine operating conditions in which no exhaust gas recirculation is necessary and said cooling means available to said exhaust gas when said detecting means detects an engine operating condition falling within a remaining area of engine operating conditions other than said specified area.

3. An exhaust gas recirculation system as recited in claim 2, and further comprising:

a blowby gas bypass passage branching off from said blowby gas passage and connected to said intake system, before a location at which said exhaust gas circulation passage is connected, so as to allow blowby gas introduced into said blowby gas passage to bypass said filtering means; and bypass valve means, disposed in said blowby gas passage, for selectively rendering said filtering means and said exhaust gas circulation passage available to said blowby gas.

4. An exhaust gas recirculation system as recited in claim 3, wherein said control means controls said bypass valve means to render said blowby gas bypass passage available to said blowby gas when said detecting means detects an engine operating condition falling within said specified area of engine operating conditions and to render said cooling means available to said blowby gas when said detecting means detects an engine operating condition falling within said remaining area of engine operating conditions.

5. An exhaust gas recirculation system as recited in claim 4, and further comprising:

a return passage, interconnected between said exhaust gas circulation passage at a position after said filtering means and the exhaust system after a location at which said exhaust gas circulation passage branches off, for allowing exhaust gas introduced into said exhaust gas circulation passage to return into the exhaust system therethrough; and valve means, disposed in said exhaust gas circulation passage, for selectively rendering said exhaust gas circulation passage and said return passage available to exhaust gas.

6. An exhaust gas recirculation system as recited in claim 5, wherein said control means controls said valve means to render said return passage available to said exhaust gas when said detecting means detects an engine operating condition falling within said specified area of engine operating conditions and said exhaust gas circulation passage available to said exhaust gas when said detecting means detects an engine operating condition falling within the remaining area of engine operating conditions.

7. An exhaust gas recirculation system as recited in claim 6, wherein said detecting means comprises a pressure sensor disposed in the intake system for detecting a pressure of intake air introduced into the internal combustion engine through the intake system.

8. An exhaust gas recirculation system of an internal combustion engine, having an intake system for introducing fresh air into the internal combustion engine, said intake system including a supercharger, and an exhaust system for discharging exhaust gas produced in the internal combustion engine therethrough, said exhaust gas recirculation system recirculating exhaust gas into intake air and comprising:

an exhaust gas circulation passage, interconnected to both the intake system before a location at which the supercharger is disposed and the exhaust system, for circulating exhaust gas into said intake system from said exhaust system;

a return passage, disposed between said exhaust gas circulation passage and the exhaust system after a location at which said exhaust gas circulation passage branches off, for returning exhaust gas introduced into said exhaust gas circulation passage into the exhaust system therethrough;

valve means, disposed in said exhaust gas circulation passage, for selectively rendering said exhaust gas circulation passage and said return passage available to exhaust gas introduced from the exhaust system;

detecting means, provided in cooperation with the internal combustion engine, for detecting engine operating conditions; and control means for controlling said valve means to render said exhaust gas circulation passage available to said exhaust gas when said detecting means detects an engine operating condition falling within a specified area of engine operating conditions in which supercharging is to be effected and said return passage available to said exhaust gas when said detecting means detects an engine operating condition falling within a remaining area of engine operating conditions other than said specified area.

9. An exhaust gas recirculation system as recited in claim 8, and further comprising:

filtering means, disposed in said exhaust gas circulation passage before a location at which said return passage branches off, for filtering exhaust gas passing therethrough; and cooling means, disposed in said exhaust gas circulation passage before said filtering means, for cooling exhaust gas passing therethrough.

10. An exhaust gas recirculation system as recited in claim 9, and further comprising:

an exhaust gas bypass passage branching off from said exhaust gas circulation passage before said cooling means and again connected to said exhaust gas circulation passage between said cooling means and said filtering means so as to allow exhaust gas introduced into said exhaust gas circulation passage to bypass said cooling means; and bypass valve means, disposed in said exhaust gas circulation passage, for selectively rendering said cooling means and said bypass passage available to said exhaust gas, said bypass valve means being controlled to render said cooling means available to said exhaust gas when said detecting means detects an engine operating condition falling within said specified area of engine operating conditions and to render said bypass passage available to said exhaust gas when said detecting means detects an engine operating condition falling within said remaining area of engine operating conditions.

11. An exhaust gas recirculation system as recited in claim 10, and further comprising:

a blowby gas bypass passage branching off from a blowby gas passage and connected to said intake system between the supercharger and a location at which said exhaust gas circulation passage is connected to so as to allow blowby gas to bypass said exhaust gas circulation passage, including said filtering means; and bypass valve means, disposed in said blowby gas passage, for selectively rendering said exhaust gas circulation passage, including said filtering means, and said blowby gas passage available to said blowby gas, said bypass valve means being controlled by said control means to render said blowby gas passage available to said blowby gas when said detecting means detects an engine operating condition falling within said specified area of engine operating conditions and to render said blowby gas bypass passage available to said blowby gas when said detecting means detects an engine operating condition falling within said remaining area of engine operating conditions.

12. An exhaust gas recirculation system as recited in claim 11, wherein said detecting means comprises a pressure sensor disposed in the intake system for detecting a pressure of intake air introduced into the internal combustion engine through the intake system.

* * * * *